US008773288B1

(12) United States Patent
Carrico et al.

(10) Patent No.: US 8,773,288 B1
(45) Date of Patent: Jul. 8, 2014

(54) METHODS FOR PRESENTING TRAFFIC INFORMATION ON AN AIRCRAFT DISPLAY UNIT

(75) Inventors: Matthew J. Carrico, Mt. Vernon, IA (US); Felix B. Turcios, Cedar Rapids, IA (US); Sarah Barber, Cedar Rapids, IA (US); Kirschen A. Seah, Cedar Rapids, IA (US); Randy H. Jacobson, Melbourne, FL (US); Patrick D. McCusker, Walker, IA (US); Christopher H. Glass, W. Melbourne, FL (US); Arnold Oldach, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 484 days.

(21) Appl. No.: 13/237,209

(22) Filed: Sep. 20, 2011

(51) Int. Cl.
*G08B 21/00* (2006.01)

(52) U.S. Cl.
USPC ..... 340/945; 340/961; 340/959; 701/9; 701/14

(58) Field of Classification Search
CPC ..... G01C 23/00; G08G 5/0021; G08G 5/0047
USPC ..... 340/959, 945, 961, 971; 701/9, 14
See application file for complete search history.

(56) References Cited

U.S. PATENT DOCUMENTS

| | | | | |
|---|---|---|---|---|
| 6,459,411 | B2 * | 10/2002 | Frazier et al. | 340/961 |
| 6,683,562 | B2 * | 1/2004 | Stayton et al. | 340/961 |
| 6,826,458 | B2 * | 11/2004 | Horvath et al. | 701/3 |
| 7,148,816 | B1 * | 12/2006 | Carrico | 340/961 |
| 7,612,716 | B2 * | 11/2009 | Smith et al. | 342/456 |
| 8,019,529 | B1 * | 9/2011 | Sharma et al. | 701/117 |
| 8,049,644 | B1 * | 11/2011 | Oehlert et al. | 340/970 |

OTHER PUBLICATIONS

U.S. Appl. No. 12/570,019, filed Sep. 30, 2009, Shapiro et al.

* cited by examiner

*Primary Examiner* — Eric M Blount
(74) *Attorney, Agent, or Firm* — Donna P. Suchy; Daniel M. Barbieri

(57) ABSTRACT

Present novel and non-trivial methods for presenting traffic information are disclosed. In a first method, data representative of ownship position, first traffic, and second traffic are received by a traffic symbology generator ("TSG"). The traffic is divided into zones and a correlation between the targets of the traffic is determined. A traffic symbology data set is generated by the TSG based upon the results of the correlation (s). In a second method, data representative of ownship position and first traffic, runway references, and a selectable display range are received by the TSG. The traffic is divided into zones, and a traffic symbology data set is generated by the TSG thereafter. In a third method, data representative of ownship position and first traffic are received by the TSG. The traffic is divided into zones, and a traffic symbology data set is generated by the TSG thereafter.

22 Claims, 10 Drawing Sheets

METHODS FOR PRESENTING TRAFFIC INFORMATION ON AN AIRCRAFT DISPLAY UNIT

BACKGROUND OF THE INVENTION

1. Field of the Invention

This invention pertains generally to the field of display units provide flight traffic information to the pilot or flight crew of an aircraft.

2. Description of the Related Art

Conventionally, avionics engineers and aviation governing authorities are improving and providing pilots and flight crews with information necessary to identify in-flight traffic. One approach that has been taken is to provide the flight crew with information on the location of other aircraft in the area. One exemplary system, which is capable of providing this information, is known as traffic alert and collision avoidance system ("TCAS"). The system is required for many aircraft including those operated by airliners operating in the United States. The TCAS has been designed to interrogate transponders of other aircraft, sometimes referred to as intruder or target aircraft. The TCAS evaluates the threat of a collision with other targets and provides traffic advisories ("TAs") and resolution advisories ("RAs"). A TA is presented to a pilot in situations in which the TCAS identifies other traffic in the area which may become a threat to the aircraft in a short period of time, and an RA is presented to the pilot when there is imminent threat to the aircraft of a collision. The RA can provide commands to the pilot corresponding to a collision avoidance maneuver.

Recently, a traffic information system referred to as automatic dependent surveillance broadcast ("ADS-B") has evolved. The ADS-B system is capable of broadcasting position, velocity, and status information from an aircraft at regular intervals using position information obtained from onboard navigation systems. The ADS-B system may use a mode S transponder or other transmitter, and provide transmissions at regular intervals. As such, ADS-B transmitters need not be interrogated by another aircraft.

Another type of traffic information system is a traffic information services broadcast ("TIS-B") system. The TIS-B system is typically a ground station which provides position, velocity, and status information of air and ground vehicles using information obtained from ADS-B, primary surveillance radar, secondary surveillance radar, and other systems. The TIS-B ground station provides a squitter message on a periodic basis similar to the squitter message in the ADS-B system. As such, the ADS-B system is commonly seen as an air-to-air link, and the TIS-B is seen as a ground-to-air link. Each of the systems provides a data link to another aircraft. A further source of traffic information may be provided from air traffic control ("ATC") via looking out the window or through a ground based or other radar system. Such information can then be communicated by the ATC to any aircraft within the vicinity of the airport.

With a variety of systems available to provide traffic information to the pilot, there is the opportunity to receive traffic information from more than one source; if so, then a correlation algorithm may be applied to determine whether targets provided from one traffic system correlate with targets provided from a second traffic system. For uncorrelated traffic, a choice may be provided by using a traffic source selection method such as the one disclosed by Carrico in U.S. Pat. No. 7,148,816. In addition, a pilot operating an aircraft located on the ground tends to use a narrow display range which provides for better surface traffic information and improves his or her ground situational awareness. Although this surface traffic information is useful, the lack of additional useful information about off-screen traffic comprised of aircraft approaching to land or landing on a runway, taking-off from the runway, and/or operating a missed approach of the runway limits the pilot's situational awareness of nearby traffic approaching the airport. In addition, with an expected increase of airborne traffic in the foreseeable future, the chance of cluttering the information presented on the display unit may possibly increase, thereby possibly interfering with the pilot's efficient access to more applicable information.

BRIEF SUMMARY OF THE INVENTION

The embodiments disclosed herein present novel and non-trivial methods for presenting traffic information on an aircraft display unit. A first method correlates data provided by two or more traffic data sources to present one target, a second method provides for off-screen traffic information when a small display range is selected, and a third method is a method to declutter the traffic information presented to the pilot.

In one embodiment, a first method is disclosed for presenting traffic information on the screen of an aircraft display unit. The method is comprised of traffic symbology generator ("TSG") receiving ownship position data, traffic data of first traffic from a first traffic data source, and traffic data of second traffic from a second traffic data source. Then, the first traffic is divided into third and fourth traffic data, and the second traffic data is divided into fifth and sixth traffic data, where the third and fifth traffic are located within a first zone and the fourth and sixth traffic are located within a second zone. Then, a correlation determination is performed to determine whether each target of the third traffic correlates with a target of the fifth traffic. A traffic symbology data set comprised of first traffic symbology and second traffic symbology is generated, where the first traffic symbology corresponds to the correlated traffic in the first zone and the second traffic symbology corresponds to uncorrelated traffic in the first zone. In addition, third traffic symbology corresponding to the fourth traffic or sixth traffic in the second zone is included in the generation of the traffic symbology data set.

In another embodiment, a second method is disclosed for presenting traffic information on the screen of an aircraft display unit. The method is comprised of the TSG receiving ownship position data, traffic data of first traffic from a first traffic data source, runway reference data of at least one runway, and range data representative of the selected range of the display unit. Then, the first traffic is divided into second and third traffic data, where the second traffic is located within a first zone for which the size is determined as a function of the selected range, and the third traffic is located in a second zone other than the first zone for which the size is determined as a function of the selected range. A traffic symbology data set comprised of first traffic symbology and second traffic symbology is generated, where the first traffic symbology corresponds to the second traffic located within the first zone, and the second traffic symbology corresponds to the third traffic located within the second zone and operating in a specific phase of flight. In addition, the TSG receives traffic data of fourth traffic from a second traffic data source. Then, the fourth traffic is divided into fifth traffic located within the first zone and sixth traffic located within the second zone, and a correlation determination is performed to determine whether each target of the second traffic correlates with a target of the fifth traffic. Each correlated target of the fifth traffic is included in the generation of the traffic symbology data set.

In another embodiment, a third method is disclosed for presenting traffic information on the screen of an aircraft display unit. The method is comprised of the TSG receiving ownship position data and traffic data of first traffic from a first traffic data source. Then, the first traffic is divided into second and third traffic data, where the second traffic corresponds to traffic located within a first zone, and the third traffic corresponds to traffic located within a second zone. Then, a traffic symbology data set comprised of first traffic symbology and second traffic symbology is generated, where the first traffic symbology corresponds to the second traffic located within the first zone, and the second traffic symbology corresponds to the third traffic located within the second zone, and the second traffic symbology for each target of the third traffic is comprised of a dot without a traffic data tag. In addition, the TSG receives traffic data of fourth traffic from a second traffic data source. Then, the fourth traffic is divided into fifth traffic located within the first zone and sixth traffic located within the second zone, and a correlation determination is performed to determine whether each target of the second traffic correlates with a target of the fifth traffic. Each correlated target of the fifth traffic is included in the generation of the traffic symbology data set.

DETAILED DESCRIPTION OF THE INVENTION

In the following description, several specific details are presented to provide a thorough understanding of embodiments of the invention. One skilled in the relevant art will recognize, however, that the invention can be practiced without one or more of the specific details, or in combination with other components, etc. In other instances, well-known implementations or operations are not shown or described in detail to avoid obscuring aspects of various embodiments of the invention.

Figure 1:
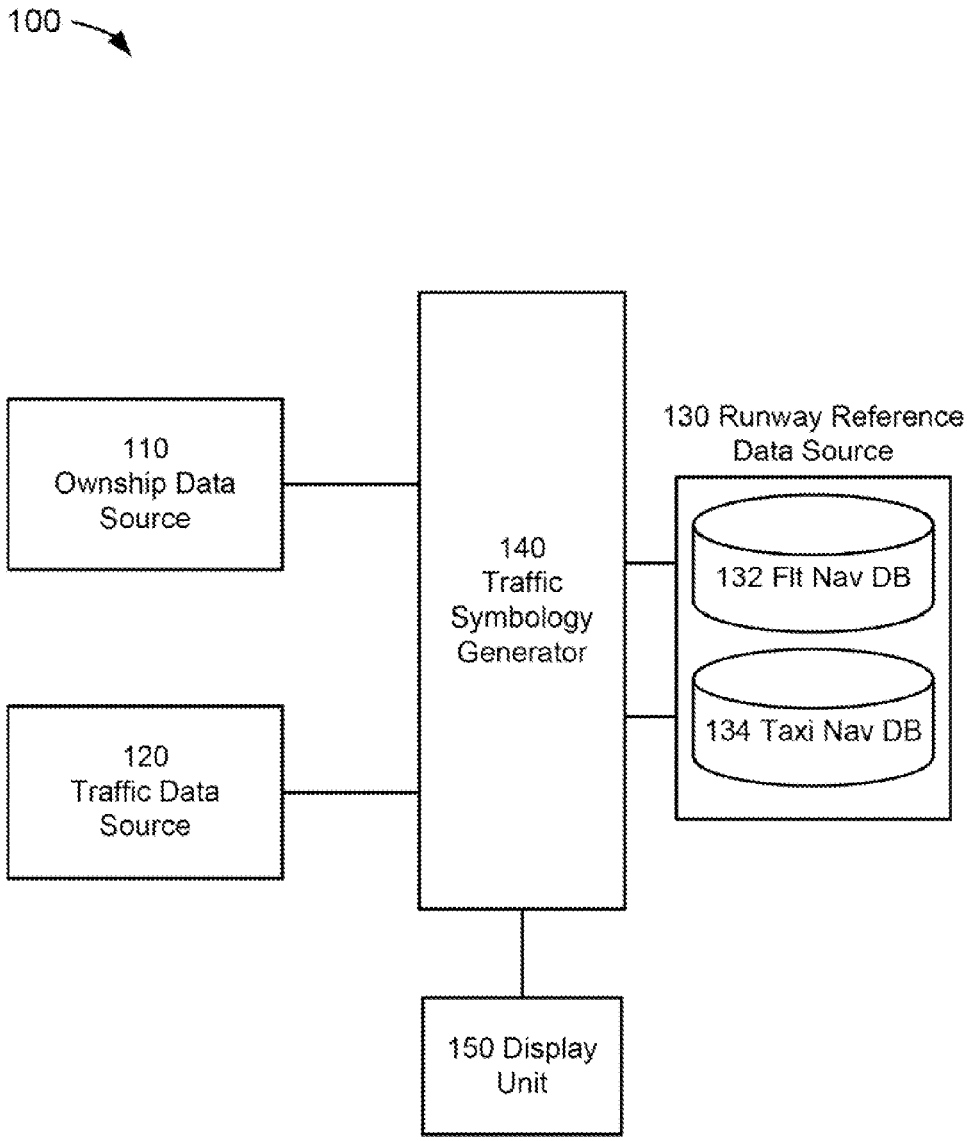
FIG. 1 depicts a block diagram of a traffic information presentation system.

FIG. 1 depicts a block diagram of a traffic information presentation system 100 suitable for implementation of the techniques described herein. The traffic information presentation system 100 of an embodiment of FIG. 1 includes an ownship data source 110, a traffic data source 120, a runway reference data source 130, a traffic symbology generator ("TSG") 140, and a display unit 150.

In an embodiment of FIG. 1, the ownship data source 110 could be comprised of any source(s) which provides data representative of ownship information, where such information could be comprised of, but not limited to, horizontal position, vertical position, pressure altitude, horizontal velocity, vertical velocity, horizontal position accuracy, vertical position accuracy, horizontal velocity accuracy, vertical velocity accuracy, and/or ownship intended flight path information. One ownship data source 110 for providing ownship information data could be a navigation system found in an aircraft. It should be noted that data, as embodied herein for any source or system in an aircraft including the navigation system, could be comprised of any analog or digital signal, either discrete or continuous, which could contain information. As embodied herein, data and signals are treated synonymously. Aircraft could mean any vehicle which is able to fly through the air or atmosphere including, but not limited to, lighter than air vehicles and heavier than air vehicles, wherein the latter may include fixed-wing and rotary-wing vehicles. Aircraft may also include any surface vehicles which operate on airport surfaces and could be equipped with the traffic information presentation system 100 disclosed herein.

The navigation system may include, but is not limited to, an air/data system, an attitude heading reference system, an inertial guidance system (or inertial reference system), a global navigation satellite system (or satellite navigation system), and/or a flight management system ("FMS") (which is comprised of, in part, a database), all of which are known to those skilled in the art. As embodied herein, the ownship data source 110 may provide ownship information data to the TSG generator 140 for subsequent processing as discussed herein.

In an embodiment of FIG. 1, the traffic data source 120 could be comprised of any source(s) which provides data representative of target information where the target could include, but not be limited to, one or more target aircraft and/or surface vehicles. For a target aircraft, target information could be comprised of, but not limited to, target aircraft identification and target aircraft intended flight path information from the ground-provided data, horizontal position, vertical position, pressure altitude, horizontal velocity, vertical velocity, horizontal position accuracy, vertical position accuracy, horizontal velocity accuracy, vertical velocity accuracy, and/or aircraft identification. The traffic data source 120 for target aircraft could be comprised of one or more systems such as, but not limited to, a traffic collision avoidance system ("TCAS"), an automatic dependent surveillance-broadcast ("ADS-B") system, an aircraft datalink system, an on-board airborne radar system, an on-board optical aircraft sensor system, a traffic information service-broadcast ("TIS-B") system, and/or an automatic dependent surveillance-rebroadcast ("ADS-R") system, each of which are known to those skilled in the art. As embodied herein, the traffic data source 120 may provide traffic and/or target information to the TSG 140 for subsequent processing as discussed herein.

In an embodiment of FIG. 1, the runway reference data source 130 could comprise any source(s) of runway reference data. The runway reference data source 130 may include, but is not limited to, a flight navigation database 132 that may be part of an FMS and/or a taxi navigation database 134. It should be noted that data contained in any database discussed herein may be stored in a digital memory storage device or computer-readable media including, but not limited to, RAM, ROM, CD, DVD, hard disk drive, diskette, solid-state memory, PCMCIA or PC Card, secure digital cards, and compact flash cards. Data contained in such databases could be loaded while an aircraft is on the ground or in flight. Data contained in such databases could be provided manually or automatically through an aircraft system capable of receiving and/or providing such manual or automated data. Any database used in the embodiments disclosed herein may be a stand-alone database or a combination of databases.

The flight navigation database 132 may contain records which provide reference data such as, but not limited to, runway data such as at least one landing threshold point ("LTP"), runway direction and elevation data, airport data, and/or approach data. The flight navigation database 132 could contain data associated with ground-based navigational aids, waypoints, holding patterns, airways, airports, heliports, instrument departure procedures, instrument arrival procedures, instrument approach procedures, runways, precision approach aids, company routes, airport communications, localizer and airway markers, restricted airspace, airport sector altitudes, enroute airways restrictions, enroute communications, preferred routes, controlled airspace, geographical references, arrival and/or departure flight planning, path point records, and GNSS Landing Systems. Such flight navigation database 132 could be provided by an aircraft system such as, but not limited to, the FMS.

The taxi navigation database 134 may be used to store airport data that may be representative of, in part, airport surfaces. Airport surfaces include, but are not limited to, locations and information delineating or defining locations of runways, taxiways, and apron areas, fixed based operators ("FBOs"), terminals, and other airport facilities. The taxi navigation database 134 could comprise an aerodrome mapping database ("AMDB") as described in the following document published by RTCA, Incorporated: RTCA DO-272A entitled "User Requirements for Aerodrome Mapping Information." DO-272A provides for aerodrome surface mapping requirements for aeronautical uses particularly on-board aircraft. Those skilled in the art appreciate that these standards may be changed with future amendments or revisions, that additional content may be incorporated in future revisions, and/or that other standards related to the subject matter may be adopted. The embodiments disclosed herein are flexible enough to include such future changes and/or adoptions without affecting the content and/or structure of an AMDB. As embodied herein, the runway reference data source 130 may provide runway reference data to the TSG generator 140 for subsequent processing as discussed herein.

In an embodiment of FIG. 1, the TSG 140 may be any electronic data processing unit which executes software or computer instruction code that could be stored, permanently or temporarily, in a digital memory storage device or computer-readable media. The TSG 140 may be driven by the execution of software or computer instruction code containing algorithms developed for the specific functions embodied herein. The TSG 140 may be an application-specific integrated circuit (ASIC) customized for the embodiments disclosed herein. Common examples of electronic data processing units are microprocessors, Digital Signal Processors (DSPs), Programmable Logic Devices (PLDs), Programmable Gate Arrays (PGAs), and signal generators; however, for the embodiments herein, the term "processor" is not limited to such processing units and its meaning is not intended to be construed narrowly. For instance, the processor could also consist of more than one electronic data processing unit. The TSG 140 could be a processor(s) used by or in conjunction with any other system of the aircraft including, but not limited to, the ownship data source 110, the traffic data source 120, the runway reference data source 130, and the display unit 150, or any combination thereof.

The TSG 140 may be programmed or configured to receive as input data representative of information obtained from various systems and/or sources including, but not limited to, the ownship data source 110, the traffic data source 120, the runway reference data source 130. As embodied herein, the terms "programmed" and "configured" are synonymous. The processor 140 may be electronically coupled to systems and/or sources to facilitate the receipt of input data. As embodied herein, operatively coupled may be considered as interchangeable with electronically coupled. It is not necessary that a direct connection be made; instead, such receipt of input data and the providing of output data could be provided through a data bus or through a wireless network. The TSG 140 may be programmed or configured to execute one or both of the methods discussed in detail below. The TSG 140 may be programmed or configured to provide a traffic symbology data set to various systems and/or units including, but not limited to, the display unit 150.

In an embodiment of FIG. 1, the display unit 150 may be comprised of any unit with a display screen on which traffic information comprised of traffic symbology may be presented to the pilot. The display unit 150 could be, but is not limited to, a PFD, ND, Head-Up Display, Head-Down Display, Multi-Purpose Control Display Unit, EICAS, Electronic Centralized Aircraft Monitor, Multi-Function Display, Side Displays, and Data Link Control Display Unit. As embodied herein, the display unit 150 may receive the traffic symbology data set provided by the TSG 140.

Figure 2A:
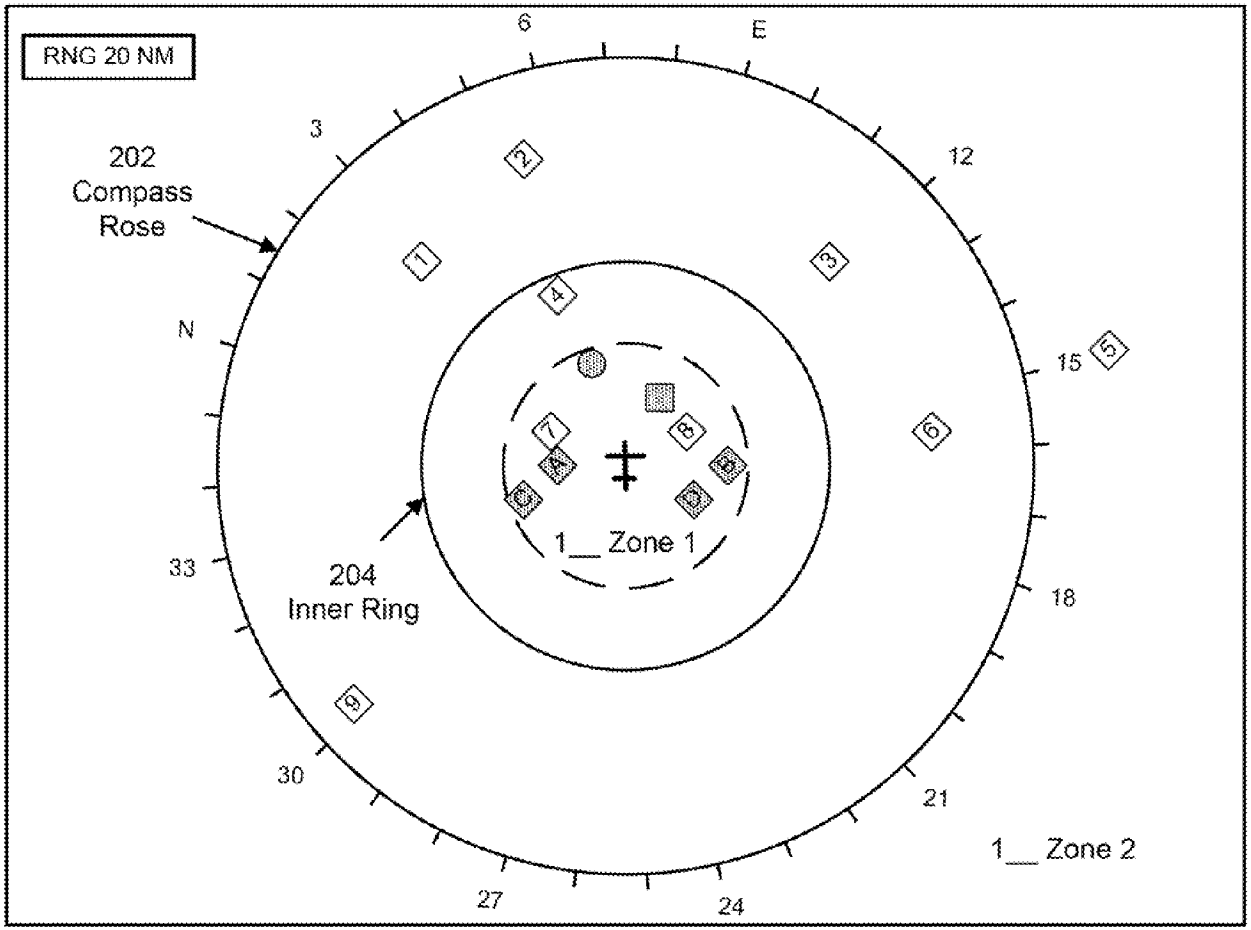
FIG. 2A provides an exemplary depiction of a display unit presenting traffic information comprised of traffic symbology of prior art.
Figure 2B:
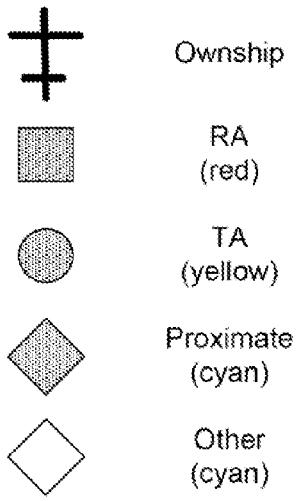
FIG. 2B provides a legend of traffic symbology presented in FIG. 2A.

The drawings of FIG. 2 depict a display unit configured to present traffic information on its screen. Traffic information may be displayed in one of a plurality of configurable modes from which one may be selected by the pilot. As shown in FIG. 2A, the pilot has selected the mode which results in a compass rose 202 being presented. The pilot may also select the range in which traffic may be displayed. As shown in FIG. 2A, the pilot has selected the range of 20 NM. The range of 20 NM is indicated by an outer ring (which coincides with the compass rose 202), and the range of 10 NM is indicated by the inner ring 204. Referring to the legend of FIG. 2B, the two rings are centered on ownship.

Those skilled in the art understand that the display of traffic information could be based upon zones. As shown in FIG. 2A, two zones centered about ownship have been created. The lateral boundary or perimeter of Zone 1 has been defined as a 6 NM radius from ownship; it should be noted that this lateral boundary is shown as a dashed line and, depending on the configuration of the display unit, may or may not be displayed on the screen. Zone 1 may also be defined with vertical boundaries. For the purpose of illustration and not limitation, the vertical boundaries will be assumed to be +/−1,200 feet with respect to ownship, which means that a ceiling exists for Zone 1 that is 1,200 feet above ownship; if ownship is located more than 1,200 feet above the ground, a floor exists 1,200 feet below ownship. Using these configurations for Zone 1, any traffic that is located 6 NM laterally and +/−1,200 feet vertically from ownship will be considered to be located within Zone 1. To those skilled in the art, Zone 1 may be considered as a "proximate" zone. The ability to configure the display unit to present multiple modes with multiple ranges from which a pilot may select is known to those skilled in the art.

Zone 2 may be considered as a zone surrounding ownship that is other than Zone 1. As shown in FIG. 2A, an inner lateral boundary of Zone 2 coincides with the lateral boundary of Zone 1. Zone 2 could be comprised of an outer lateral boundary, but for the purpose of discussion herein, it will be assumed to be located outside the range of the display selected by the pilot Zone 2 may also be comprised of one or more ceilings and/or floors. One ceiling could exist if ownship is more than 1,200 feet above the ground; if so, then the floor of Zone 1 could coincide with a ceiling of Zone 2. A second ceiling could be considered as a "cut-off" for which traffic above will not be displayed. One floor for Zone 2 could coincide with the ceiling of Zone 1, and if ownship is more than 1,200 feet above the ground, a second floor could coincide with the ground. The ability to configure the presentation of traffic information based upon multiple zones is known to those skilled in the art.

Traffic information is displayed by symbology, and the symbologies shown in FIG. 2A represent prior art symbologies used in a TCAS. Referring to both FIGS. 2A and 2B, the traffic information is comprised of a total of fifteen targets: eight targets are within the 6 NM lateral boundary from ownship, and seven are beyond the 6 NM. As indicated by the two unfilled diamonds within 6 NM from ownship (labeled as targets 7 and 8), the two targets are not "proximate" (where Zone 1 is considered the proximate zone). Although they are located within the lateral boundary of Zone 1, they are located outside of one or two vertical boundaries. This means that targets 7 and 8 are located either above the ceiling or below the floor of Zone 1 and within Zone 2. Of the total of fifteen targets, six targets (four of them labeled A-D) are located within Zone 1 and nine targets (labeled targets 1-9) are located within Zone 2.

As indicated by the display of the filled red square, a resolution advisory ("RA") has been issued for one target because it falls within an RA region. Those skilled in the art understand that an RA region may be a region of the proximate zone within which the target is considered to pose a collision threat if it is located within a defined time and/or distance. For example, a manufacturer and/or end-user could define the RA region as that region within which a target poses a collision threat 25 seconds or less from ownship, a target is located laterally in front of ownship by a distance of 2.1 NM, and/or a target is located vertically +/−600 feet from ownship.

As indicated by the display of the filled yellow circle, a traffic advisory ("TA") has been issued for one target because it falls within a TA region. Those skilled in the art understand that a TA region may be a region of the proximate zone within which the target is considered to pose a collision threat if it is located within a defined time and/or distance that is greater than the RA. For example, a manufacturer and/or end-user could define the TA region as that region within which a target poses a collision threat 25 to 40 seconds from ownship, a target is located laterally in front of ownship by a distance of 3.3 NM, and/or a target is located vertically +/−850 feet from ownship.

As indicated by the display of filled cyan diamonds, four targets A-D are located within the proximate zone but outside of the RA region and the TA region. As indicated by the display of unfilled cyan diamonds, nine targets 1-9 are located outside of the proximate zone.

Those skilled in the art understand that "traffic data tags" are typically presented adjacent to each target symbology to provide the pilot with additional information about the target. For the purpose of discussion only and not of limitation, the "traffic data tags" have not been included in the drawings of FIGS. 2 through 5, inclusive. The embodiments disclosed herein include the presence of "traffic data tags" unless a target is presented as a dot; if the target is presented as a dot, then the "traffic data tags" may be inhibited from being presented with the dot symbology that is displayed on the screen of the display unit 150.

Figure 3B:
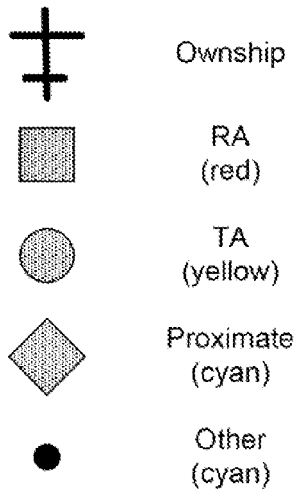
FIG. 3B provides a legend of traffic symbology presented in FIG. 3A.
Figure 4B:
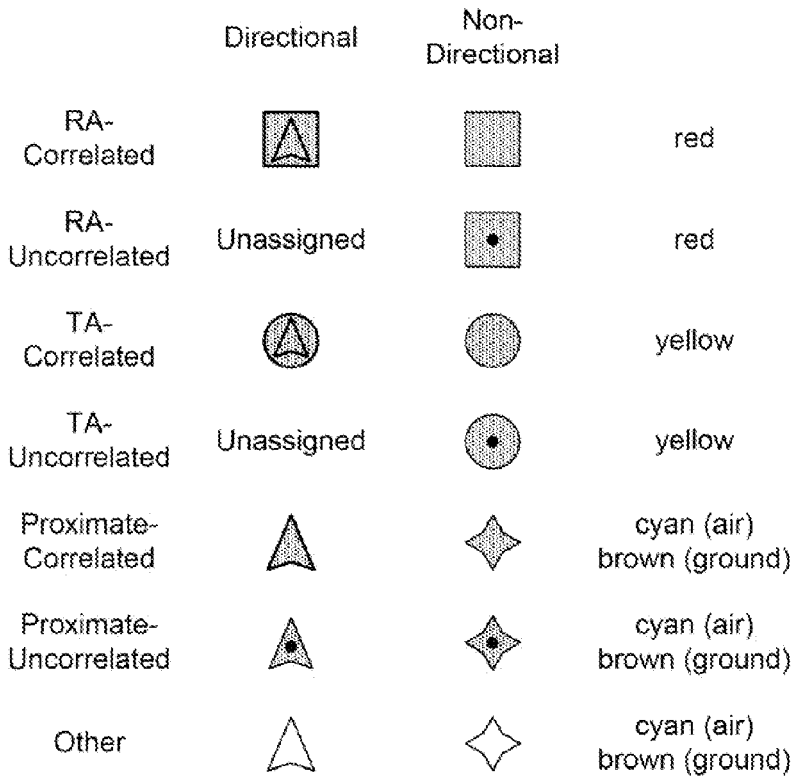
FIG. 4B provides a legend of traffic symbology presented in FIG. 4A.
Figure 3A:
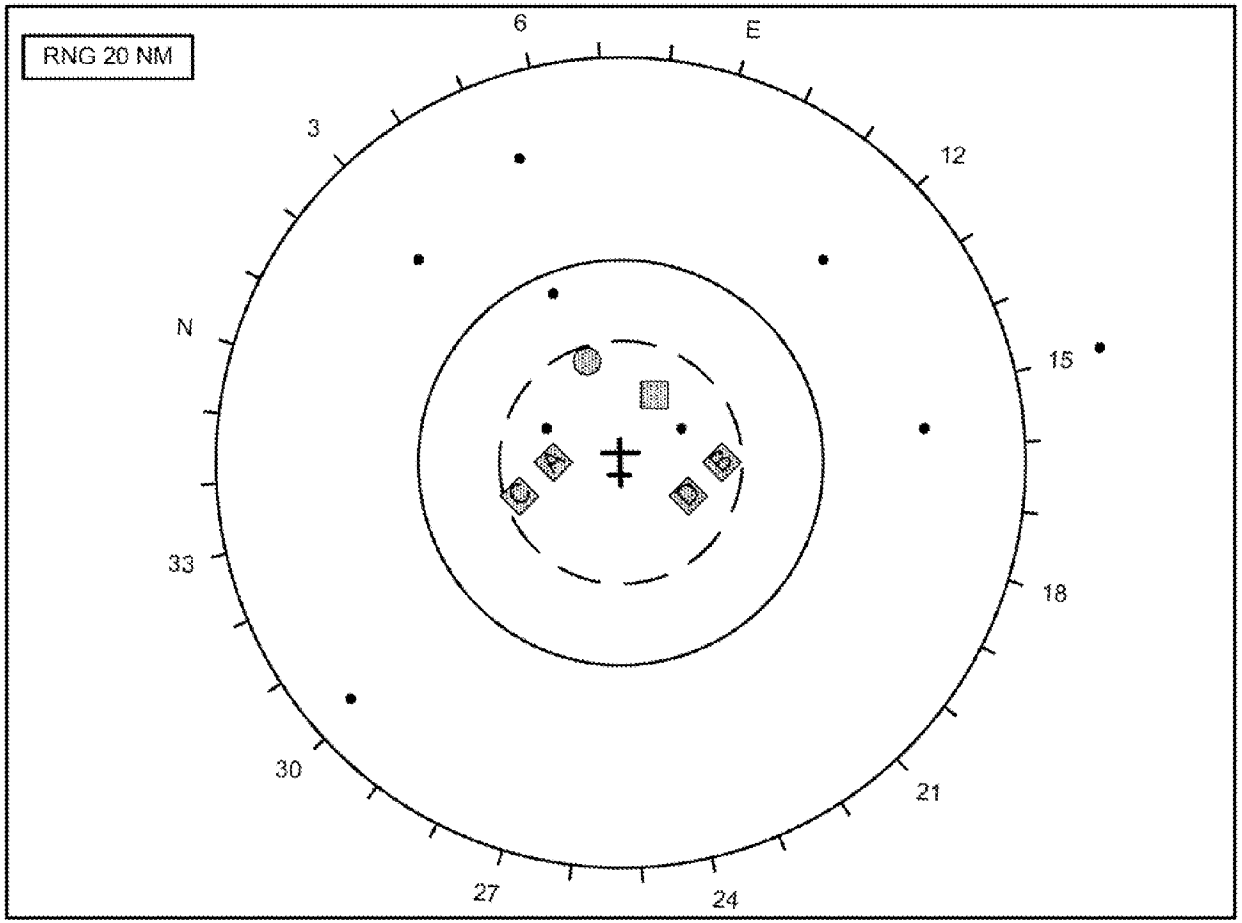
FIG. 3A provides a first exemplary depiction of a display unit presenting traffic information comprised of traffic symbology.
Figure 4A:
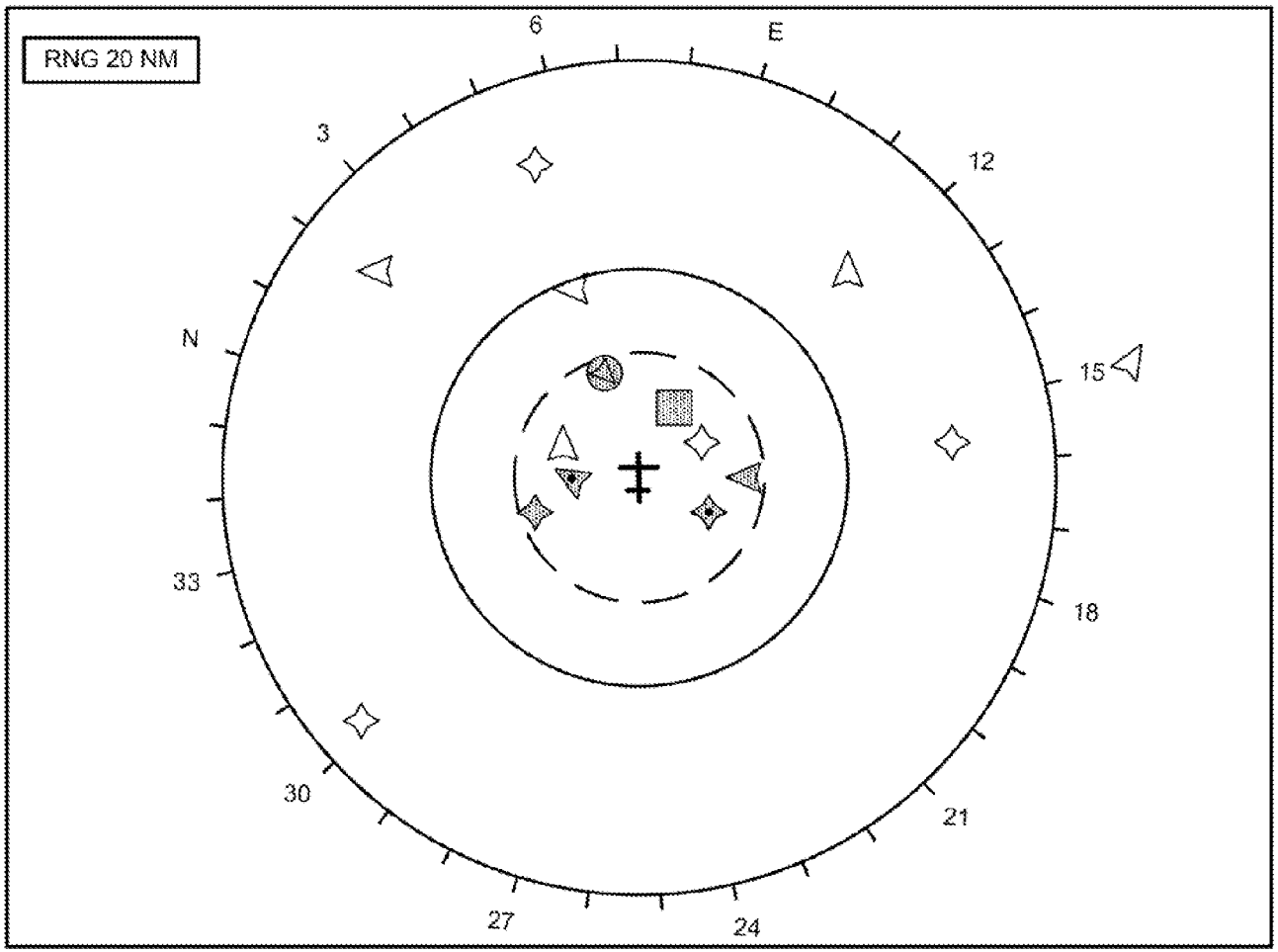
FIG. 4A provides a second exemplary depiction of a display unit presenting traffic information comprised of traffic symbology.

The advantages and benefits of the embodiments disclosed herein may be illustrated by showing examples in the drawings of FIGS. 3 and 4 of traffic symbologies to improve a pilot's situational awareness. The display unit shown in FIG. 2A and the traffic information comprised of the targets presented thereon will be used in the drawings of FIGS. 3 and 4. In the embodiments of the drawings of FIG. 3, the screen footprint of target symbology has been reduced, thereby reducing screen clutter and improving the pilot's situational awareness. Instead of symbology comprised of an unfilled cyan diamond symbology, a dot may be used for each target located outside of the proximate zone. While the color of the dot is configurable by the manufacturer and/or end-user, cyan dots are displayed for target 1-9.

While the symbology disclosed in the drawings in FIG. 3 may be employed when traffic information is acquired from one traffic data source, additional symbologies may be employed when traffic information is acquired from one or more one traffic data sources. In the embodiments of the drawings of FIG. 4, a set of target symbologies are disclosed where the symbologies may not only be comprised of zone-based classifications such as RA, TA, Proximate, and Other but also be comprised of correlation-based and direction-based classifications.

As indicated by the symbology of the filled red square presented on the screen of the display unit, an RA has been issued for one target because it falls within an RA region as stated above; the RA may have been issued by one or more traffic data sources. The lack of the presence of a dot inlay inside the filled red square indicates that the target has been correlated; that is, one target represented in the traffic data acquired from one traffic data source has been identified to be the same target represented in the traffic data acquired from a second source. Whether a target has been correlated may be determined through the use of at least one correlation algorithm known to those skilled in the art. In addition, the lack of a chevron inlay inside the filled red square indicates that the direction of the target's movement has not been provided or ascertained.

As indicated by the symbology of the filled yellow circle, a TA has been issued for one target because it falls within a TA region as stated above; the TA may have been issued by one or more traffic data sources. The presence of a chevron inside the filled yellow circle indicates that the direction of the target's movement has been provided or ascertained.

With respect to the traffic located within the proximate zone but not within the RA region or the TA region, the symbology corresponding to target A of the filled cyan chevron with a dot inlay informs the pilot of an uncorrelated target and its direction of movement. The symbology corresponding to target B of the filled cyan chevron without a dot inlay informs the pilot of a correlated target and its direction of movement. The symbology corresponding to target C of the filled cyan pinched diamond without a dot inlay informs the pilot of a correlated target but without its direction of movement. The symbology corresponding to target D of the filled cyan pinched diamond with a dot inlay informs the pilot of an uncorrelated target but without its direction of movement.

With respect to the traffic located outside of the proximate zone, the symbologies corresponding to targets 1, 3, 4, 5, and 7 of the unfilled cyan chevrons inform the pilot of targets and their respective direction of movement. The symbologies corresponding to targets 2, 6, 8, and 9 of unfilled pinched diamonds inform the targets but without their respective direction of movement. It should be noted that correlation information of targets located outside of the proximate zone could be determined; if so, dot inlays may be added to the chevron to indicate target correlation.

Figure 5A:
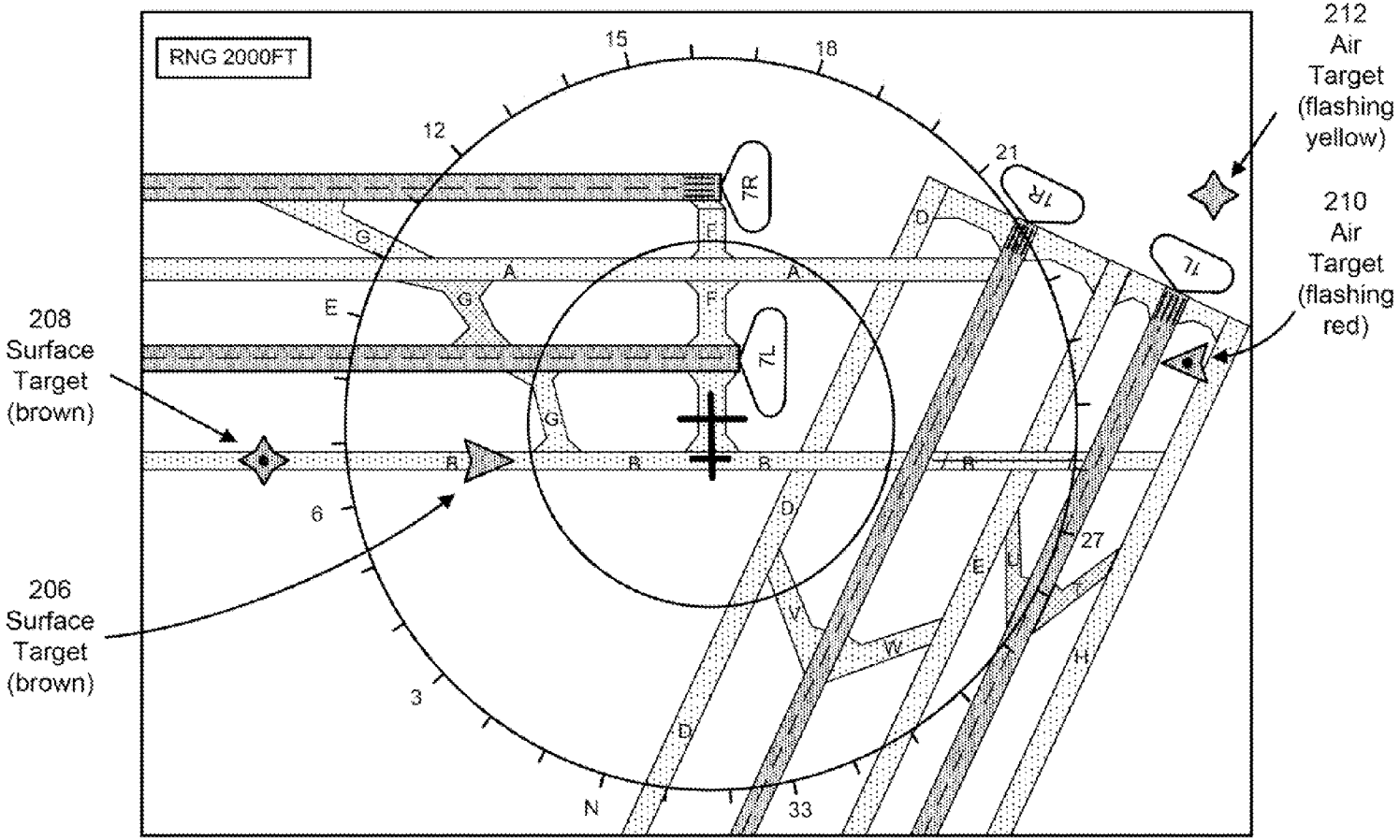
FIG. 5A provides a third exemplary depiction of a display unit presenting traffic information comprised of traffic symbology.

The advantages and benefits of the embodiments disclosed herein may be further illustrated by showing examples in the drawings of FIG. 5 traffic symbologies to improve a pilot's situational awareness by displaying off-screen landing or approaching to land targets, missed approach targets, and/or take-off targets along with targets located on the ground. As shown in FIG. 5A, an airport surface map ("ASM") is presented on the screen of the display unit, the pilot has selected the compass rose mode with a range of 2,000 feet, and ownship is located on Taxiway F and has been issued a "hold short of Runway 7L" taxi clearance.

The traffic information overlaying the ASM is comprised of a total of four targets: two surface targets 206 and 208, and two air targets 210 and 212. Referring to the legend of FIG. 4B, the symbology corresponding to surface target 206 of the filled brown chevron informs the pilot of a correlated traffic and its direction of movement; here, the surface target 206 is moving on Taxiway B towards ownship. The symbology corresponding to surface target 208 of the filled brown pinched diamond with a dot inlay informs the pilot of an uncorrelated target but without its direction of movement; here, the surface target 208 is located on Taxiway B, but its direction is unknown.

The symbology corresponding to air target 210 of the filled red blinking chevron with a dot inlay informs the pilot of an uncorrelated off-screen target with its direction of movement. Here, the manufacturer and/or end-user could have selected the use of red to indicate a threat that is located within a defined time and/or distance from ownship. Similar to the discussion above, the use of the color red could signify that the target is located 25 seconds or less away from ownship or at a distance of 2.2 NM. Also, the use of blinking symbology could signify that the target is off-screen; that is, the target is located beyond a range corresponding to the selected range of 2,000 feet. Using the inner ring and the compass rose as a scale, the range corresponding to the selection of the 2,000 range is approximately 3,000 feet when measured to the right-hand edge of the screen. Furthermore, the display of an off-screen target could be limited to a target that is located within specific zones as discussed below; a discussion of the construction of a landing awareness zone is provided below. Given this additional configuration information, the symbology of air target 210 informs the pilot of an uncorrelated off-screen target that is located within a landing awareness zone, moving in the direction of Runway 7L, more than 3,000 feet away from ownship, but less than either 25 seconds or 2.2 NM away. In other words, the pilot is informed of a pending landing of an aircraft on Runway 7L and that his "hold short" clearance is likely due to aircraft located on the final approach to Runway 7L.

The symbology corresponding to air target 212 of the filled yellow blinking pinched diamond without a dot inlay informs the pilot of a correlated off-screen target but without its direction of movement. Here, the manufacturer and/or end-user could have selected the use of yellow to indicate a threat that is located within a defined time and/or distance from ownship. Similar to the discussion above, the use of the color yellow could signify that the target is located 25 to 40 seconds from ownship or at a distance of 3.3 NM and within a landing awareness zone. Also, the use of blinking symbology could signify that the target is off-screen. Using the inner ring and the compass rose as a scale, the range of the target corresponding to the selection of the 2,000 range is approximately 3,200 feet when measured to the right-hand edge of the screen. As stated above, the display of an off-screen target could be limited to a target that is located within a landing awareness zone and approaching to land on a runway. Given this additional configuration information, the symbology of air target 212 informs the pilot of a correlated off-screen target that is located within a landing awareness zone, moving in an unknown direction, more than 3,300 feet away from ownship, more than 25 seconds away, but less than 40 seconds or 2.2 NM away. In other words, the pilot is informed of an approaching aircraft located in a landing awareness zone of one or more runways that would otherwise not be displayed because of the selected range of the display unit.

Figure 5B:
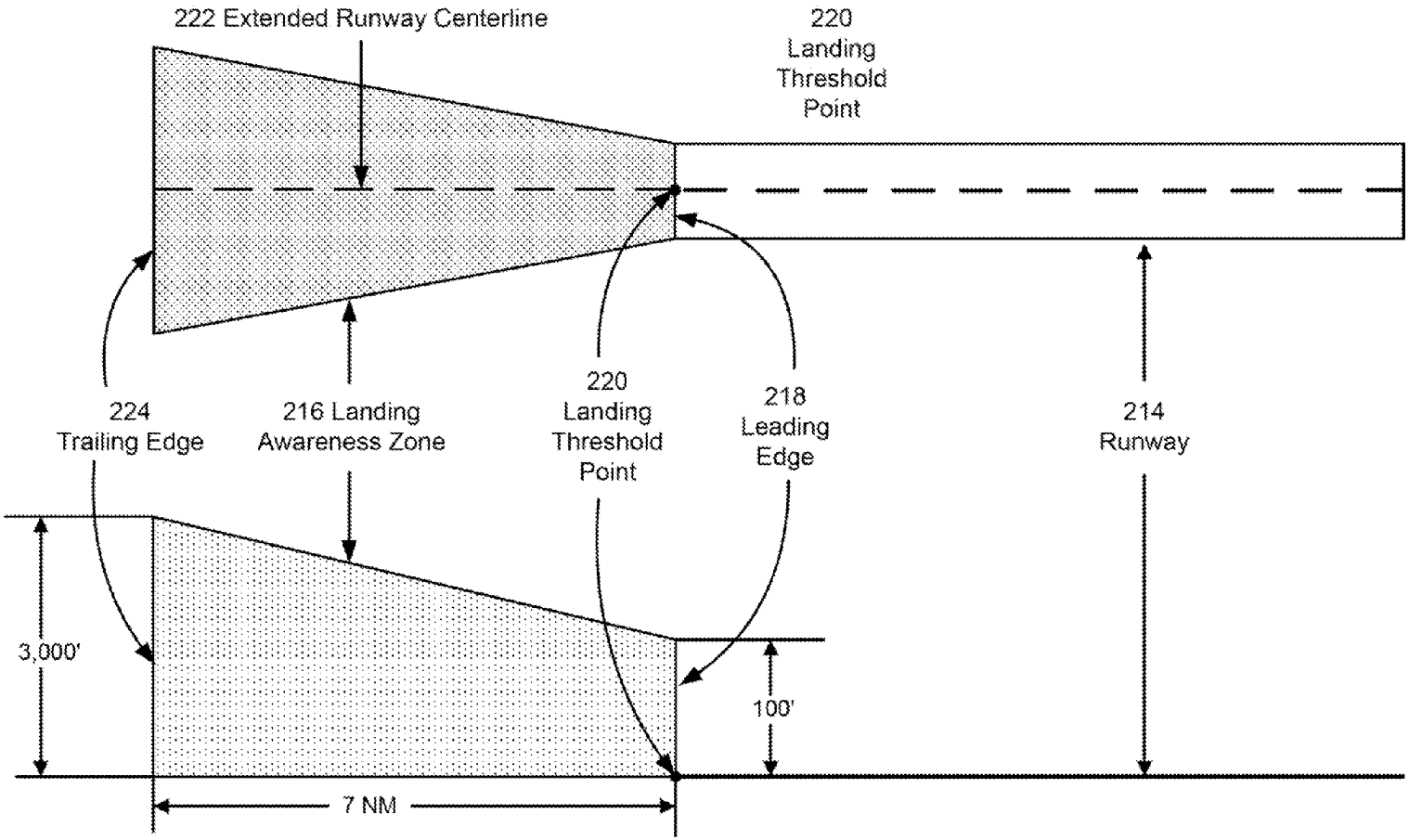
FIG. 5B illustrates a landing awareness zone.

To construct a landing awareness zone, there may be a plurality of techniques. A runway 214 and landing awareness zone 216 (not to scale) are depicted in FIG. 5B. The landing awareness zone 216 is assumed to have been configured by a manufacturer and/or end-user as a trapezoid, where a leading edge 218 of the landing awareness zone 216 has been configured to coincide with a plane intersecting through an LTP 220 that is perpendicular to the extended runway centerline 222. The trailing edge 224 of the landing awareness zone 216 has been configured to be 7 NM from the LTP 220. The length of the leading edge 218 has been configured to coincide with the width of the runway at the LTP, and the length of the trailing edge 224 (not depicted) has been configured to be approximately 1,200 feet (or 600 feet on each side of and perpendicular to the extended runway centerline 222). The height of the leading edge 218 has been configured to be 100 feet above the LTP 220, and the height of the trailing edge 224 has been configured to be 3,000 feet. It should be noted that, although this example provides a simple geometric shape made up of straight lines to define the landing awareness zone 216, the embodiments herein are not limited to such a shape but may include any fixed or variable geometric configuration chosen and/or selected by a manufacturer or end-user.

In addition to landing awareness zones, zones may be constructed for the purpose of identifying those off-screen aircraft that are taking off or executing a missed approach. Similar to the landing awareness zone, take-off zones and/or missed approach zones may be constructed with any fixed or variable geometric configuration chosen and/or selected by a manufacturer or end-user to identify targets operating in those phases of flight.

Figure 6:
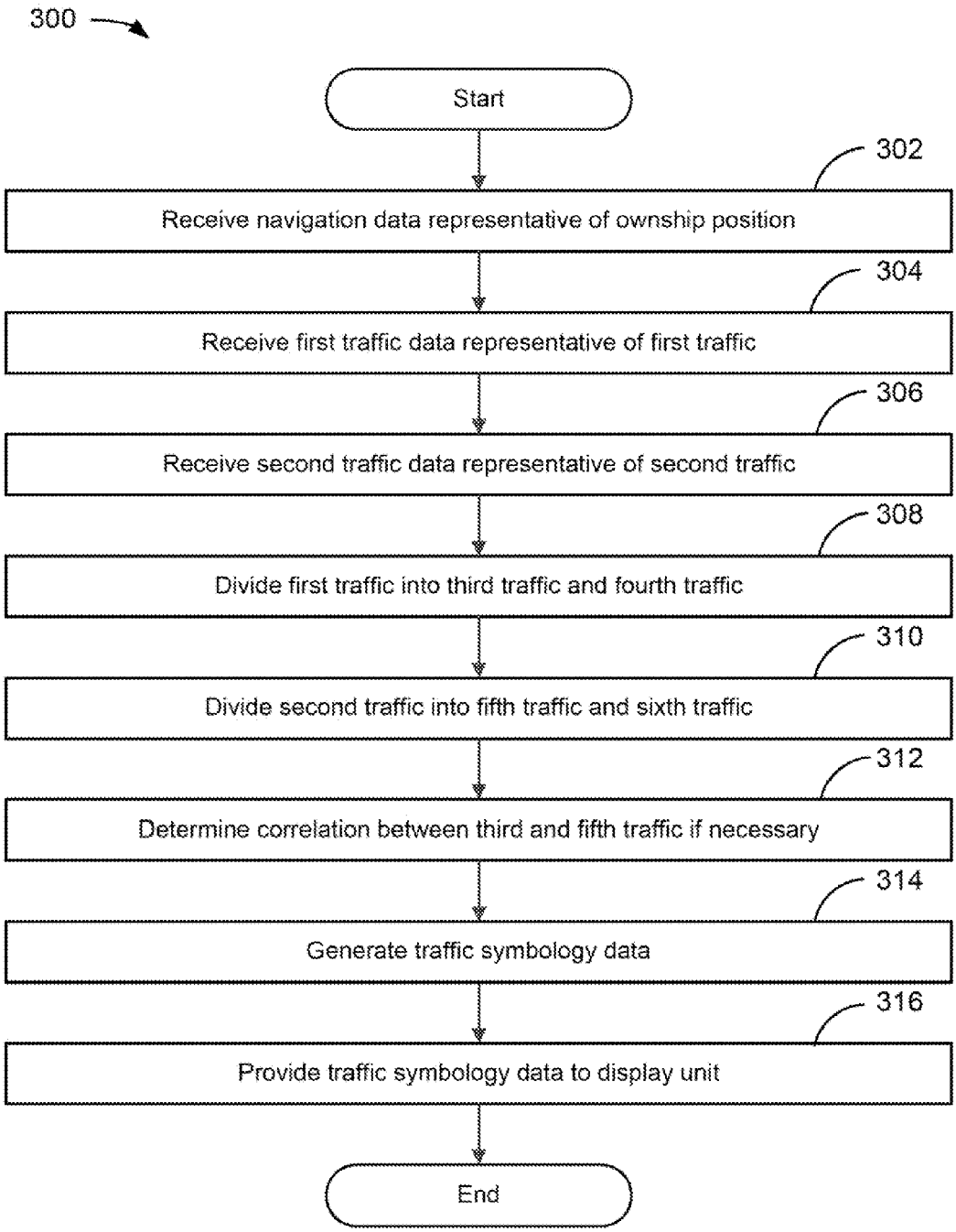
FIG. 6 depicts a flowchart of a first method presenting traffic information on an aircraft display unit.
Figure 7:
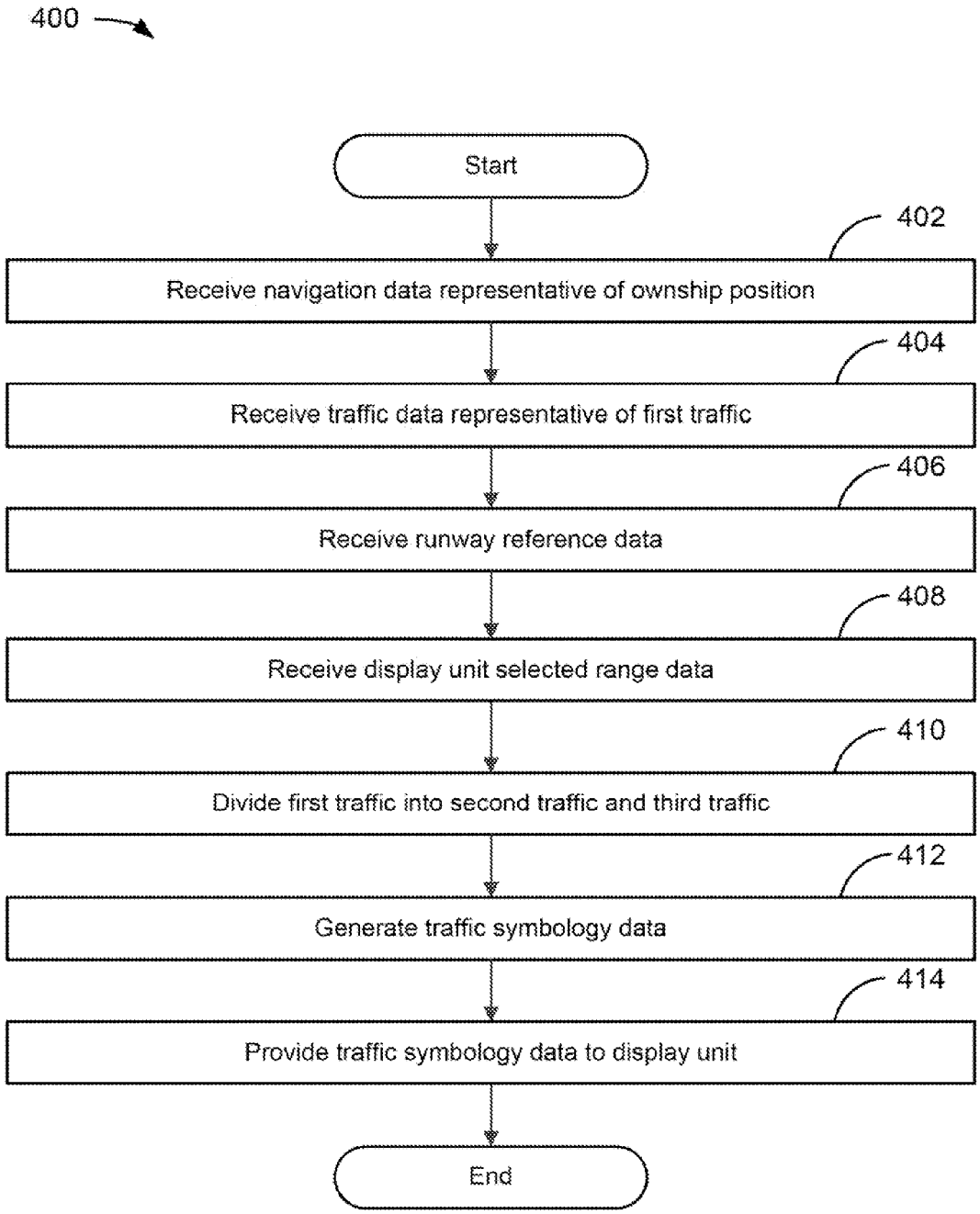
FIG. 7 depicts a flowchart of a second method presenting traffic information on an aircraft display unit.
Figure 8:
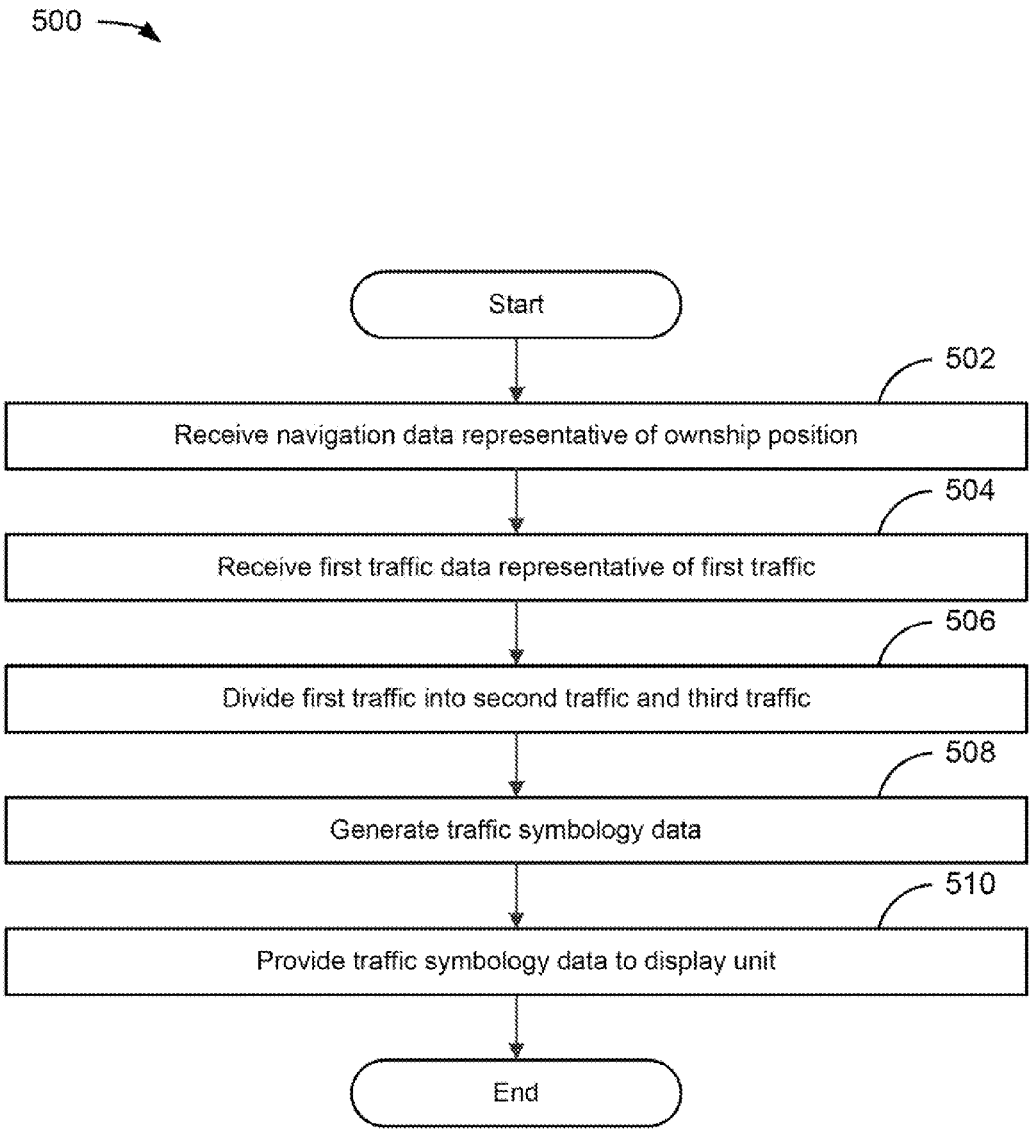
FIG. 8 depicts a flowchart of a third method presenting traffic information on an aircraft display unit.

FIG. 6 depicts flowchart 300 disclosing an example of a first method for presenting traffic information on an aircraft display unit, FIG. 7 depicts flowchart 400 disclosing an example of a second method for presenting traffic information on an aircraft display unit, and FIG. 8 depicts flowchart 500 disclosing an example of a third method for presenting traffic information on an aircraft display unit, where the TSG 140 may be programmed or configured with instructions corresponding to the following modules embodied in flowcharts 300, 400, and 500. As embodied herein, the TSG 140 may be a processor or a combination of processors used as part of the ownship data source 110, the traffic data source 120, the runway reference data source 130, and/or the display unit 150. Also, the TSG 140 may be a processor of a module such as, but not limited to, a printed circuit card having one or more input interfaces to facilitate the two-way data communications of the TSG 140, i.e., the receiving and providing of data. As necessary for the accomplishment of the following modules embodied in flowcharts 300, 400, and 500, the receiving of data is synonymous and/or interchangeable with the retrieving of data, and the providing of data is synonymous and/or interchangeable with the making available or supplying of data.

As shown in FIG. 6, the flowchart 300 is depicted. The flowchart begins with module 302 with the receiving of navigation data. This data may be representative of the position of ownship.

The flowchart continues with module 304 with the receiving of first traffic data from a first traffic data source 120. The first traffic data may be representative of first traffic comprised of one or more targets such as, but not limited to, aircraft and/or surface vehicles. As embodied herein, the first traffic data may include correlation information. Also, one or more RAs and/or TAs could be included in the first traffic data.

The flowchart continues with module 306 with the receiving of second traffic data from a second traffic data source 120. Similar to the first traffic data, the second traffic data may be representative of second traffic comprised of one or more targets such as, but not limited to, aircraft and/or surface vehicles. As embodied herein, the second traffic data may include correlation information. Also, one or more RAs and/or TAs could be included in the second traffic data.

The flowchart continues with module 308 with the dividing of the first traffic into two or more zones. The first traffic may be divided into third traffic corresponding to the first traffic located within a first zone and fourth traffic corresponding to the first traffic located within a second zone, where the second zone is a zone other than the first zone. The first zone may be centered on ownship and defined laterally with a perimeter (i.e., boundary) and vertically with a ceiling and/or a floor; the second zone could envelope the first zone and/or may be defined laterally with an inner and outer perimeter (where the inner perimeter could coincide with the perimeter of the first zone) and vertically with ceilings and/or floors, where one ceiling and one floor could coincide with a floor and ceiling of the first zone, respectively.

The flowchart continues with module 310 with the dividing of the second traffic into two or more zones. Similar to the first traffic, the second traffic may be divided into fifth traffic corresponding to the second traffic located within the first zone and sixth traffic corresponding to the second traffic located within the second zone.

The flowchart continues with module 312 the determining of whether a correlation exists between each target of the third traffic and each target of the fifth traffic; however, it may not be necessary to make this determination if the correlation information between the targets has been provided to the TSG 140 in the first traffic data and/or second traffic data. To determine if there is a correlation between targets, a correlation algorithm may be applied to determine if one target acquired by the first traffic data source 120 and provided in the first traffic data is the same target acquired by the second traffic data source 120 and provided in the second traffic data. The correlation algorithm is known to those skilled in the art.

The flowchart continues with module 314 the generating of a traffic symbology data set comprised of first traffic symbology data and second traffic symbology data. The first traffic symbology data could be representative of first traffic symbology which corresponds to each correlated target, the second traffic symbology data could be representative of second traffic symbology which corresponds to each uncorrelated target, and the first traffic symbology and the second traffic symbology may be configured to be visually distinguishable from each other when presented on the screen of the display unit.

As embodied herein, the traffic symbology data set could be further comprised of third traffic symbology which corresponds to each target of the fourth traffic or the sixth traffic, where the choice to use either the fourth traffic or the sixth traffic for the generation of the third traffic symbology may be made with the use of a predetermined selection algorithm. The third traffic symbology may be configured to be visually distinguishable from the first traffic symbology and the second traffic symbology. For example, each target of the third traffic symbology could be comprised of a dot; however, if a target is identified as operating in an emergency or rapid descent (e.g., exceeding a configurable minimum descent rate), this target could be excluded from being presented as a dot without a traffic data tag, where the traffic data tag may be intentionally inhibited from being presented.

In addition, if RA or TA information has been included in the first traffic data and/or the second traffic data, the first traffic symbology and/or second traffic symbology, as applicable, could further correspond to an RA or a TA for one or more correlated targets of the third or fifth traffic or an RA or a TA for one or more uncorrelated targets of the third or fifth traffic. The first traffic symbology and/or second traffic symbology may be configured so that the RAs or the TAs of the correlated traffic may be visually distinguishable from the RAs or the TAs of the uncorrelated traffic.

In another embodiment, the size of the first and second zone could depend on a selected display range. Data representative of a selected range of the display unit and runway reference data representative of one or more runway reference points could be received from the runway reference data source 130 for the construction of a landing awareness zone. Here, the size of the first zone could correspond to the range of the selected display range, and the size of the second zone could correspond to the range exceeding the selected display range. Then, the traffic symbology data set could be further comprised of fourth traffic symbology data representative of fourth traffic symbology corresponding to each target of the fourth traffic or the sixth traffic which has been identified to be operating in one or more of the following phases of flight: approach to landing and landing phase, missed approach phase, and/or take-off phase, where awareness zones such as a landing awareness zone, missed approach zone, and take-off zone, respectively, could be used to identify whether the traffic located within such zone(s). The fourth traffic symbology may be configured to be visually distinguishable from the other traffic symbologies being displayed.

In addition, the first zone (for which the size is dependent upon the selected range display) could be divided into third and fourth zones. If so, then the first traffic symbology could further correspond to each correlated target of the third traffic and the fifth traffic located within the third zone, and the second traffic symbology could further correspond to each uncorrelated target of the third traffic or the fifth traffic located within the third zone. Also, the traffic symbology data set could be further comprised of fifth traffic symbology data representative of fifth traffic symbology corresponding to each target of the third traffic or the fifth traffic located within the fourth zone, where each target in the fourth zone is comprised of a dot without a traffic data tag. Referring to FIG. 5A, surface target 208 could be comprised of a dot without a traffic data tag if the third zone is defined as the zone within the 2,000 feet range and/or surface targets 206 and 208 could be comprised of dots without traffic data tags if the third zone is defined as the zone within the 1,000 feet range.

Returning to FIG. 6, the flowchart continues with module 316 the providing of the traffic symbology data set to the display unit 150. The display unit may be configured to receive the traffic symbology data set and present an image represented in the first traffic symbology data on the screen of the display unit. Then, flowchart 300 proceeds to the end.

As shown in FIG. 7, the flowchart 400 is depicted. The flowchart begins with module 402 with the receiving of navigation data. This data may be representative of the position of ownship.

The flowchart continues with module 404 with the receiving of first traffic data from a first traffic data source 120. The first traffic data may be representative of first traffic comprised of one or more targets such as, but not limited to, aircraft and/or surface vehicles. As embodied herein, the first traffic data may include correlation information. Also, one or more RAs and/or TAs could be included in the first traffic data.

The flowchart continues with module 406 with the receiving of runway reference data representative of one or more runways, which could be provided by the runway reference data source 130. Runway reference data could be data representative of an LTP and runway direction that could be used in the construction of a landing awareness zone.

The flowchart continues with module 408 with the receiving of data representative of a selected range of the display unit. This data could be used to determine the size and shape of a first zone.

The flowchart continues with module 410 with the dividing of the first traffic into two or more zones. The first traffic may be divided into second traffic corresponding to the first traffic located within the first zone and third traffic corresponding to the first traffic located within a second zone, where the size of the first zone could correspond to the range of the selected display range, and the size of the second zone could correspond to a range exceeding the selected display image.

In addition, the first zone (for which the size is dependent upon the selected range display) could be divided into third and fourth zones. If so, then the first traffic symbology could further correspond to the second traffic located within the third zone. Also, the traffic symbology data set could be further comprised of third traffic symbology data representative of third traffic symbology corresponding to the second traffic located within the fourth zone, where each target in the fourth zone is comprised of a dot without a traffic data tag. Referring to FIG. 5A, surface target 208 could be comprised of a dot without a traffic data tag if the third zone is defined as the zone within the 2,000 feet range and/or surface targets 206 and 208 could be comprised of dots without traffic data tags if the third zone is defined as the zone within the 1,000 feet range.

Returning to FIG. 7, second traffic data could be received from a second traffic data source 120 in an additional embodiment. Similar to the first traffic data, the second traffic data may be representative of fourth traffic comprised of one or more targets such as, but not limited to, aircraft and/or surface vehicles. As embodied herein, the second traffic data may include correlation information. Also, one or more RAs and/or TAs could be included in the second traffic data.

The fourth traffic could be divided into fifth traffic corresponding to the second traffic located within the first zone and sixth traffic corresponding to the fourth traffic located within the second zone. Then, a correlation determination could be made to determine whether correlation exists between each target of the second traffic and each target of the fifth traffic; however, it may not be necessary to make this determination if the correlation information between the targets has been provided to the TSG 140 in the first traffic data and/or the second traffic data.

The flowchart continues with module 412 the generating of a traffic symbology data set comprised of first traffic symbology data and second traffic symbology data. The first traffic symbology data could be representative of first traffic symbology which corresponds to the second traffic and the second traffic symbology data could be representative of second traffic symbology which corresponds to the third traffic which has been identified to be operating in one or more of the following phases of flight: approach to landing and landing phase, missed approach phase, and/or take-off phase, where awareness zones such as a landing awareness zone, missed approach zone, and take-off zone, respectively, could be used to identify whether the traffic located within such zone(s). The first traffic symbology and the second traffic symbology may be configured to be visually distinguishable from each other when presented on the screen of the display unit.

If a correlation between each target of the second traffic and each target of the fifth traffic has been made, the first traffic symbology could further correspond to the fifth traffic, where the first traffic symbology corresponding to each correlated target of the second traffic and the fifth traffic may be configured to be visually distinguishable from the first traffic symbology corresponding to each uncorrelated target of the second traffic and the fifth traffic.

The flowchart continues with module 414 the providing of the traffic symbology data set to the display unit 150. The display unit may be configured to receive the traffic symbology data set and present an image represented in the traffic symbology data set on the screen of the display unit. Then, the flowchart 400 proceeds to the end.

As shown in FIG. 8, the flowchart 500 is depicted. The flowchart begins with module 502 with the receiving of navigation data. This data may be representative of the position of ownship.

The flowchart continues with module 504 with the receiving of first traffic data from a first traffic data source 120. The first traffic data may be representative of first traffic comprised of one or more targets such as, but not limited to, aircraft and/or surface vehicles. As embodied herein, the first traffic data may include correlation information. Also, one or more RAs and/or TAs could be included in the first traffic data.

The flowchart continues with module 506 with the dividing of the first traffic into two or more zones. The first traffic may be divided into second traffic corresponding to the first traffic located within a first zone and third traffic corresponding to the first traffic located within a second zone, where the second zone is a zone other than the first zone.

The flowchart continues with module 508 the generating of a traffic symbology data set comprised of first traffic symbology data and second traffic symbology data. The first traffic symbology data could be representative of first traffic symbology which corresponds to the second traffic, the second traffic symbology data could be representative of second traffic symbology which corresponds to the third traffic, the first traffic symbology and the second traffic symbology may be configured to be visually distinguishable from each other when presented on the screen of the display unit, and the second traffic symbology for each target could be comprised of a dot; however, if a target is identified as operating in an emergency or rapid descent (e.g., exceeding a configurable minimum descent rate), this target could be excluded from being presented as a dot without a traffic data tag, where the traffic data tag may be intentionally inhibited from being presented.

In an additional embodiment, second traffic data could be received from a second traffic data source 120. Similar to the first traffic data, the second traffic data may be representative of fourth traffic comprised of one or more targets such as, but not limited to, aircraft and/or surface vehicles. As embodied herein, the second traffic data may include correlation information. Also, one or more RAs and/or TAs could be included in the second traffic data.

The fourth traffic could be divided into fifth traffic corresponding to the second traffic located within the first zone and sixth traffic corresponding to the fourth traffic located within the second zone. Then, a correlation determination could be made to determine whether correlation exists between each target of the second traffic and each target of the fifth traffic; however, it may not be necessary to make this determination if the correlation information between the targets has been provided to the TSG 140 in the first traffic data and/or second traffic data.

If a correlation between each target of the second traffic and each target of the fifth traffic has been made, the first traffic symbology could further correspond to the fifth traffic, where the first traffic symbology corresponding to each correlated target of the second traffic and the fifth traffic may be configured to be visually distinguishable from the first traffic symbology corresponding to each uncorrelated target of the second traffic and the fifth traffic.

In addition, if RA or TA information has been included in the first traffic data and/or the second traffic data, the first traffic symbology and/or second traffic symbology, as applicable, could further correspond to an RA or a TA for one or more correlated targets of the second or fifth traffic or an RA or a TA for one or more uncorrelated targets of the second or fifth traffic. The first traffic symbology and/or second traffic symbology may be configured so that the RAs or the TAs of the correlated traffic may be visually distinguishable with the RAs or the TAs of the uncorrelated traffic.

In another embodiment, the size of the first and second zone could depend on a selected display range. Data representative of a selected range of the display unit and runway reference data representative of one or more runway reference points could be received from the runway reference data source 130 for the construction of a landing awareness zone. Here, the size of the first zone could correspond to the range of the selected display range, and the size of the second zone could correspond to the range exceeding the selected display range. Then, the traffic symbology data set could be further comprised with third traffic symbology data representative of third traffic symbology corresponding to each target of the third traffic which has been identified to be operating in one or more of the following phases of flight: approach to landing and landing phase, missed approach phase, and/or take-off phase, where awareness zones such as a landing awareness zone, missed approach zone, and take-off zone, respectively, could be used to identify whether the traffic located within such zone(s). The third traffic symbology may be configured to be visually distinguishable from the other traffic symbologies being displayed.

The flowchart continues with module 510 the providing of the traffic symbology data set to the display unit 150. The display unit may be configured to receive the traffic symbology data set and present an image represented in the traffic symbology data set on the screen of the display unit. Then, the flowchart 500 proceeds to the end.

It should be noted that the method steps described above may be embodied in computer-readable media as computer instruction code. It shall be appreciated to those skilled in the art that not all method steps described must be performed, nor must they be performed in the order stated.

As used herein, the term "embodiment" means an embodiment that serves to illustrate by way of example but not limitation.

It will be appreciated to those skilled in the art that the preceding examples and embodiments are exemplary and not limiting to the scope of the present invention. It is intended that all permutations, enhancements, equivalents, and improvements thereto that are apparent to those skilled in the art upon a reading of the specification and a study of the drawings are included within the true spirit and scope of the present invention. It is therefore intended that the following appended claims include all such modifications, permutations and equivalents as fall within the true spirit and scope of the present invention.

What is claimed is:

1. A method for presenting traffic information on an aircraft display unit, said method comprising:

receiving data representative of ownship position from a navigation data source;

receiving first traffic data representative of first traffic comprised of at least one target from a first traffic data source;

receiving second traffic data representative of second traffic comprised of at least one target from a second traffic data source;

dividing the first traffic into third traffic and fourth traffic, where the third traffic corresponds to the first traffic located within a first zone of a plurality of zones, and the fourth traffic corresponds to the first traffic located within a second zone which is a zone other than the first zone;

dividing the second traffic into fifth traffic and sixth traffic, where the fifth traffic corresponds to the second traffic located within the first zone, and the sixth traffic corresponds to the second traffic located within the second zone;

determining whether there is a correlation between each target of the third traffic and each target of the fifth traffic if correlation information has not been received in either the first traffic data, the second traffic data, or both;

generating a traffic symbology data set comprised of first traffic symbology data representative of first traffic symbology corresponding to each correlated target of the third traffic and the fifth traffic, and second traffic symbology data representative of second traffic symbology corresponding to each uncorrelated target of the third traffic or the fifth traffic, such that the first traffic symbology and the second traffic symbology are visually distinguishable from each other when presented on the screen of the display unit; and providing the traffic symbology data set to a display unit, whereby an image represented in the traffic symbology data set is subsequently presented on the screen of the display unit.

2. The method of claim 1, wherein the traffic symbology data set is further comprised of third traffic symbology data representative of third traffic symbology corresponding to each target of the fourth traffic or the sixth traffic, such that the third traffic symbology is visually distinguishable from the first traffic symbology and the second traffic symbology.

3. The method of claim 2, wherein the third traffic symbology for each target, except for each target identified as operating in an emergency or rapid descent, is comprised of a dot without a traffic data tag, the use of either the third traffic or the fifth traffic for the correspondence with the second symbology has been predetermined with a traffic source selection method, the use of either the fourth traffic or the sixth traffic has been predetermined with a traffic source selection method, or any combination of these.

4. The method of claim 1, wherein the first traffic data includes a resolution advisory or a traffic advisory for at least one target of the first traffic, the second traffic data include a resolution advisory or a traffic advisory for at least one target of the second traffic, or both, such that the first traffic symbology further corresponds to a resolution advisory or a traffic advisory for at least one correlated target of the third traffic and the fifth traffic, the second traffic symbology further corresponds to a resolution advisory or a traffic advisory for at least one uncorrelated target of the third traffic or the fifth traffic, such that the resolution advisory or the traffic advisory for at least one correlated target of the third traffic and the fifth traffic is visually distinctive from the resolution advisory or the traffic advisory for at least one uncorrelated target of the third traffic or the fifth traffic, and each resolution advisory is visually distinctive from each traffic advisory.

5. The method of claim 1, further comprising:

retrieving runway reference data corresponding to at least one runway from a runway reference data source; and receiving range data representative of a selected range of the display unit, such that a size of the first zone corresponds to the selected range of the display unit, a size of the second zone corresponds to a range exceeding the selected range of the display unit, and the traffic symbology data set is further comprised of fourth traffic symbology data representative of fourth traffic symbology corresponding to each target of the fourth traffic or the sixth traffic that is operating in an approach to landing and landing phase, missed approach phase, take-off phase, or a combination of any of these phases, such that the fourth traffic symbology is visually distinguishable from the first traffic symbology and the second traffic symbology.

6. The method of claim 5, further comprising:

constructing a landing awareness zone, missed approach zone, or take-off zone, or any combination of these for each runway based upon the runway reference data, where each target of the fourth traffic or the sixth traffic that is operating in an approach to landing and landing phase, missed approach phase, take-off phase, or a combination of any of these phases is located within its applicable awareness zone.

7. The method of claim 5, wherein the first zone is divided into a third zone and a fourth zone, such that the first traffic symbology further corresponds to each correlated target of the third traffic and the fifth traffic located within the third zone, and the second traffic symbology further corresponds to each uncorrelated target of the third traffic or the fifth traffic located within the third zone, and the traffic symbology data set is further comprised of fifth traffic symbology data representative of fifth traffic symbology corresponding to the third traffic or fifth traffic located within the fourth zone, where each target in the fourth zone is comprised of a dot without a traffic data tag.

8. A method for presenting traffic information on an aircraft display unit, said method comprising:

receiving data representative of ownship position from a navigation data source;

receiving first traffic data representative of first traffic comprised of at least one target from a first traffic data source;

retrieving runway reference data corresponding to at least one runway from a runway reference data source;

receiving range data representative of a selected range of a display unit;

dividing the first traffic into second traffic and third traffic, where the second traffic corresponds to the first traffic located within a first zone of a plurality of zones, where a size of the first zone corresponds to the selected range of the display unit, and the third traffic corresponds to the first traffic located within a second zone which is a zone other than the first zone, where a size of the second zone corresponds to a range exceeding the selected range of the display unit;

generating a traffic symbology data set comprised of first traffic symbology data representative of first traffic symbology corresponding to the second traffic, and second traffic symbology data representative of second traffic symbology corresponding to the third traffic that is operating in an approach to landing and landing phase, missed approach phase, take-off phase, or a combination of any of these phases, such that the first traffic symbology and the second traffic symbology are visually distinguishable from each other when presented on the screen of the display unit; and providing the traffic symbology data set to a display unit, whereby an image represented in the traffic symbology data set is subsequently presented on the screen of the display unit.

9. The method of claim 8, further comprising:

constructing a landing awareness zone, missed approach zone, or take-off zone, or any combination of these for each runway based upon the runway reference data, where each target of the fourth traffic or the sixth traffic that is operating in an approach to landing and landing phase, missed approach phase, take-off phase, or a combination of any of these phases is located within its applicable awareness zone.

10. The method of claim 8, wherein the first zone is divided into a third zone and a fourth zone, such that the first traffic symbology further corresponds to the second traffic located within the third zone, and the traffic symbology data set is further comprised of third traffic symbology data representative of third traffic symbology corresponding to the second traffic located within the fourth zone, where each target in the fourth zone is comprised of a dot without a traffic data tag.

11. The method of claim 9, further comprising:

receiving second traffic data representative of fourth traffic comprised of at least one target from a second traffic data source;

dividing the fourth traffic into fifth traffic and sixth traffic, where the fifth traffic corresponds to the fourth traffic located within the first zone, and the sixth traffic corresponds to the fourth traffic located within the second zone; and determining whether there is a correlation between each target of the second traffic and each target of the fifth traffic if correlation information has not been received in either the first traffic data, the second traffic data, or both, such that the first traffic symbology further corresponds to the fifth traffic, such that the first traffic symbology corresponding to each correlated target of the second traffic and the fifth traffic is visually distinguishable from the first traffic symbology corresponding to each uncorrelated target of the second traffic or the fifth traffic.

12. The method of claim 11, wherein the use of either the second traffic or the fifth traffic for the first traffic symbology corresponding to each uncorrelated target has been predetermined with a traffic source selection method.

13. A method for presenting traffic information on an aircraft display unit, said method comprising:

receiving data representative of ownship position from a navigation data source;

receiving first traffic data representative of first traffic comprised of at least one target from a first traffic data source;

dividing the first traffic into second traffic and third traffic, where the second traffic corresponds to the first traffic located within a first zone of a plurality of zones, and the third traffic corresponds to the first traffic located within a second zone which is a zone other than the first zone;

generating a traffic symbology data set comprised of first traffic symbology data representative of first traffic symbology corresponding to the second traffic, and second traffic symbology data representative of second traffic symbology corresponding to the third traffic, such that the first traffic symbology and the second traffic symbology are visually distinguishable from each other when presented on the screen of the display unit, and the second traffic symbology for each target, except for each target identified as operating in an emergency or rapid descent, is comprised of a dot without a traffic data tag; and providing the traffic symbology data set to a display unit, whereby an image represented in the traffic symbology data set is subsequently presented on the screen of the display unit.

14. The method of claim 13, wherein the first traffic data includes a resolution advisory or a traffic advisory for at least one target of the first traffic, such that the first traffic symbology further corresponds to a resolution advisory or a traffic advisory of at least one target of the second traffic, such that each resolution advisory is visually distinctive from each traffic advisory.

15. The method of claim 13, further comprising:

receiving second traffic data representative of fourth traffic comprised of at least one target from a second traffic data source;

dividing the fourth traffic into fifth traffic and sixth traffic, where the fifth traffic corresponds to the fourth traffic located within the first zone, and the sixth traffic corresponds to the fourth traffic located within the second zone; and determining whether there is a correlation between each target of the second traffic and each target of the fifth traffic if correlation information has not been received in either the first traffic data, the second traffic data, or both, such that the first traffic symbology further corresponds to the fifth traffic, such that the first traffic symbology corresponding to each correlated target of the second traffic and the fifth traffic is visually distinguishable from the first traffic symbology corresponding to each uncorrelated target of the second traffic or the fifth traffic.

16. The method of claim 15, wherein the use of either the second traffic or the fifth traffic for the first traffic symbology corresponding to each uncorrelated target has been predetermined with a traffic source selection method.

17. The method of claim 13, wherein the first traffic data includes a resolution advisory or a traffic advisory for at least one target of the first traffic, the second traffic data includes a resolution advisory or a traffic advisory for at least one target of the fourth traffic, or both, such that the first traffic symbology further corresponds to a resolution advisory or a traffic advisory of at least one target of the second traffic, a resolution advisory or a traffic advisory of at least one target of the fifth traffic, or both, such that the resolution advisory or the traffic advisory for each correlated target of the second traffic and the fifth traffic is visually distinctive from the resolution advisory or the traffic advisory for each uncorrelated target of the second traffic or the fifth traffic, and each resolution advisory is visually distinctive from each traffic advisory.

18. The method of claim 17, wherein the use of either the second traffic or the fifth traffic for the first traffic symbology corresponding to each uncorrelated target has been predetermined with a traffic source selection method.

19. The method of claim 13, further comprising:

retrieving runway reference data corresponding to at least one runway from a runway reference data source; and receiving range data representative of a selected range of the display unit, such that a size of the first zone corresponds the selected range of the display unit, a size of the second zone corresponds to a range exceeding the selected range of the display unit, and the traffic symbology data set is further comprised of third traffic symbology data representative of third traffic symbology corresponding to each target of the third traffic that is operating in an approach to landing and landing phase, missed approach phase, take-off phase, or a combination of any of these phases, such that the third traffic symbology is visually distinguishable from the first traffic symbology and the second traffic symbology.

20. The method of claim 19, further comprising:

constructing a landing awareness zone, missed approach zone, or take-off zone, or any combination of these for each runway based upon the runway reference data, where each target of the third traffic that is operating in an approach to landing and landing phase, missed approach phase, take-off phase, or a combination of any of these phases is located within its applicable awareness zone.

21. The method of claim 19, further comprising:

receiving second traffic data representative of fourth traffic comprised of at least one target from a second traffic data source;

dividing the fourth traffic into fifth traffic and sixth traffic, where the fifth traffic corresponds to the fourth traffic located within the first zone, and the sixth traffic corresponds to the fourth traffic located within the second zone; and determining whether there is a correlation between each target of the second traffic and each target of the fifth traffic if correlation information has not been received in either the first traffic data, the second traffic data, or both, such that the first traffic symbology further corresponds to the fifth traffic, such that the first traffic symbology corresponding to each correlated target of the second traffic and the fifth traffic is visually distinguishable from the first traffic symbology corresponding to each uncorrelated target of the second traffic or the fifth traffic.

22. The method of claim 21, wherein the use of either the second traffic or the fifth traffic for the first traffic symbology corresponding to each uncorrelated target has been predetermined with a traffic source selection method.

* * * * *